United States Patent [19]

Amelang

[11] Patent Number: 4,458,511

[45] Date of Patent: Jul. 10, 1984

[54] KEY HOLDER

[76] Inventor: Walter Amelang, 3754 Maroneal, Houston, Tex. 77025

[21] Appl. No.: 380,619

[22] Filed: May 21, 1982

[51] Int. Cl.[3] ..... A47G 29/10

[52] U.S. Cl. ..... 70/456 B

[58] Field of Search ..... 70/456 B, 456 R, 457, 70/458, 459; 150/40; 24/3 K

[56] References Cited

U.S. PATENT DOCUMENTS

| | | | |
|---|---|---|---|
| 295,158 | 3/1984 | Fisher | 70/458 |
| 1,667,676 | 4/1928 | Price | 70/456 B |
| 3,826,118 | 7/1974 | Kruger | 70/456 B |

FOREIGN PATENT DOCUMENTS

| | | | |
|---|---|---|---|
| 1429751 | 1/1966 | France | 70/456 B |

*Primary Examiner*—Robert L. Wolfe

*Attorney, Agent, or Firm*—Vaden, Eickenroht, Thompson, Bednar & Jamison

[57] ABSTRACT

A key holder for mounting keys in a key case by a novel support member. The member provides a permanent mounting for a plurality of key loops adapted for releaseably carrying keys or the like. The key loops have stable forward and rearward positions substantially parallel to the body of the key case, but they pivot easily between these positions.

The member is a folded thin metal plate having slots extending in a curved portion at the folded region and holes provided at one end of the slots. The key loops each have an integral disc at the end of an offset shank which ends in a coil onto which a key is threaded. The disc is passed through the spaced holes formed at the end of each slot after the member is folded onto itself. The plate extends sufficiently beyond the curved portion to receive and support the keys in their rearward position.

10 Claims, 6 Drawing Figures

FIG. 1
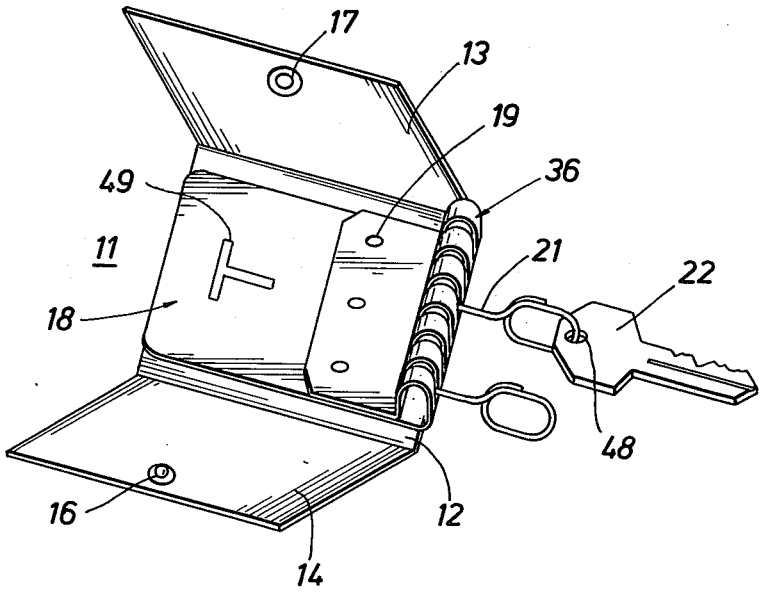
FIG. 2
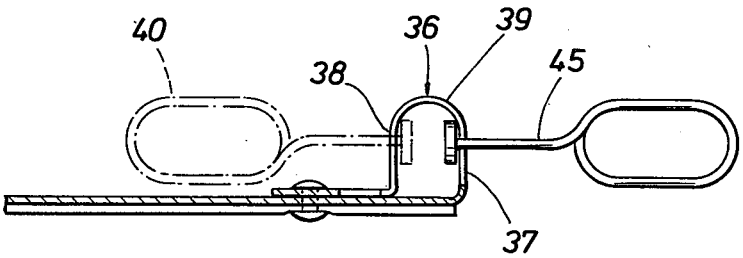
FIG. 3
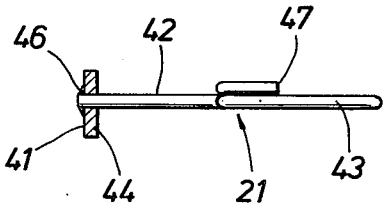
FIG. 4
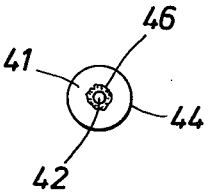
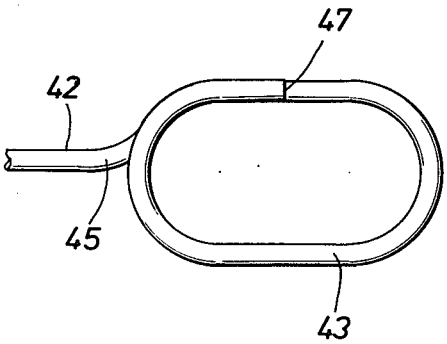
FIG. 5
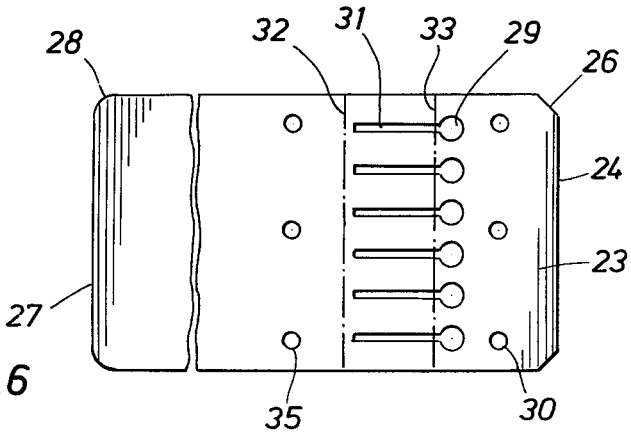
FIG. 6

KEY HOLDER

BACKGROUND OF THE INVENTION

1. Field of the Invention

This invention relates to locks and keys, and it more particularly relates to key cases adapted to carry a plurality of keys or the like.

2. Description of Prior Art

Various types of key carrying articles, such as key cases, have been provided for many years to make convenient the use of keys to open locks, etc. Probably, the most common key case is of the type having a two flap cover secured by a snap fastener. Within the case is a metal plate having a pivoting support for a plurality of wire loops onto which keys can be selectively secured. The wire loops have an enlargement at one end of their shank. This enlargement is secured within slots in the pivoting support. Also, the metal plate is arranged so that the enlargement on the wire loop can be released so that the wire loop and key can be removed as a unit from the key case. One reason for this key and loop removal function is that it is difficult to separate quickly or easily the key from the wire loop. It has been found that this function leads to a great weakness in design of key cases in that the pivotal mounting of the enlargement in the support is subject to rapid wear. As a result of this wear, the enlargement can unintentionally slip from the support and then the associated key is lost.

Designs have been made in the wire loop to facilitate removal of the key from the key case. For example, a quick releasing wire loop is shown in U.S. Pat. No. 4,277,963. In many cases, the removal function of the key and wire loop directly from the pivoting support has been retained.

The present invention provides a unique key holder wherein the loop carrying the key, or the like, is permanently secured in its pivotal mounting within the key case. Also, the loop is arranged by an enclosing coil to provide for the ready threaded mounting and demounting of a key onto the coil.

SUMMARY OF THE INVENTION

In accordance with this invention, there is provided a key holder for releasably mounting keys on a support member within a key case. The support member has a foldable thin rectangular metal plate. A plurality of uniformly spaced holes are aligned laterally across a first end of the plate. Thin slots extend longitudinally in the plate from the holes a certain distance towards the second end of the plate. First and second fold lines extend transversely across the plate adjacent the ends of the slots and adjacent the connection of the slots and holes, respectively. The plate is folded on these fold lines so that the first end rests in juxtaposition along a part of the second end of the plate, and the slots reside in a curved portion of the plate formed between the fold lines. A key loop is permanently secured at one end in a slideable mounting in each slot and at its other end is adapted to be releasably secured to a key or the like.

Preferably, the key loop has a disc integrally carried on an offset shank which connects to an enclosed loop or oblong coil. The disc is adapted to pass through the spaced holes after folding of the plate for its permanent pivotal mounting to the curved portion thereof. The coil has its free end spaced laterally from the shank for the ready threaded mounting of an orificed key thereon.

The disc on the key loop also provides stable forward and rearward positions of keys relative to the key case.

DESCRIPTION OF THE DRAWINGS

FIG. 1 is a pictorial view illustrating one embodiment of the key holder arranged according to the present invention;

FIG. 2 is an enlarged longitudinal section through the key holder;

FIG. 3 is an enlarged view of one key loop use in the key holder;

FIG. 4 is an end view of the key loop of FIG. 3;

FIG. 5 is an enlarged view of the loop or enclosed oblong coil carried on the kep loop of FIG. 3; and FIG. 6 is a plan view of a metal plate illustrating the various holes, slots, openings and fold lines which are incorporated into the key holder shown in the preceeding views.

In the several figures in the drawings, like elements will carry like numerals to simplify description of the key holder of this invention.

DESCRIPTION OF PREFERRED EMBODIMENTS

Referring to FIG. 1, there is shown a key holder 11 constructed in accordance with this invention. As shown, the key holder 11 is in the form of a key case having a body 12 of flexible material such as leather or plastic sheet carrying hinged flaps 13 and 14 that are releasably secured by a snap fastener with mating parts 16 and 17. The key holder has a support member 18 mounted to the body 12 by fasteners 19. A plurality of key loops 21 are permanently secured at one of their ends within a pivotal mounting to the support member 18. A key 22, or the like, is releaseably secured at a loop end on the key loop 21.

More particularly, the support member 18 is formed from a thin rectangular metal plate 23 which is adapted to be folded into angular and curved configurations. Although most metals can be used for the plate 23, it is desirable to use stainless steel in a sheet form having a thickness of about 1 mm for ready fabrication and an extended long service life to the user of the key case.

As best seen in FIG. 6, the plate 23 is rectangular in shape with a first end 24 having rounded or beveled corners 26. The second end 27 on the plate 23 may have rounded corners 28. A plurality of uniformly spaced holes 29 are aligned laterally across the first end 24 of the plate 23. For example, the holes 29 may have a diameter of 5 mm. A like plurality of parallel thin slots 31 extend longitudinally from the holes 29 to a certain distance towards the second end 27 in the plate 23. This distance is generally the spacing between the transverse fold lines 32 and 33.

The plate 23 also has two transverse rows of mounting holes 30 and 35 to receive the fasteners 19 after the plate 23 has been folded.

The fold line 32 is placed adjacent the ends 34 of the slots 31. The fold line 33 is placed across the slots 31 adjacent to their connection with the holes 29. The plate 23 will be folded along these fold lines in the following manner which can be best visualized by a reference to FIGS. 1, 2 and 6.

The plate 23 is bent into a right angle at the fold line 32. The bending operation can be made using a sheet metal brake, or other suitable machine. Then, the first end 24 of the plate is bent into a right angle along the fold line 33, but in a reverse direction to the folding along line 32. Now, the plate between the fold lines is bent into a curved portion 36 using a round mandrel to prevent distortion of the sheet metal. Alternatively, the several bends can be made into the plate using stamping and folding dies. After bending, the first end 24 resides in juxtaposition over a part of the second end 26 of the plate 23. Now, the mounting holes 30 and 35 are in alignment to receive the fasteners 19.

The curved portion 36 has straight walls 37 and 38 adjacent the fold lines and a round wall 39 connecting them together. The slots 31 extend the lengths of the walls forming the curved portion 36. Also, the slots 31 extend a small distance from the fold line 33 to the holes 29. As a result, the key loops 21 can be mounted into the support member 18 and after completion of the bending operations.

Each key loop 21 has an integral enlarged part 41 carried at one end of a shank 42. The shank 42 has an intermediate offset 45 and carries at its other end an enclosed loop or coil 43. Preferably, the loop 21 is formed of a resilient metal wire wherein the shank 42 and coil 43 are one-piece and attached to a flat metal disc 44 for providing the enlarged part 41.

As best seen in FIGS. 3 and 4, the disc 44 has a central opening to receive the shank 42, and they can be secured in any manner such as by a weld or brazed area 46. The disc 44 has a diameter or exterior size arranged to allow it to be inserted through the holes 29 in the first end 24 of the plate 23. In some cases, the first end 24 may be lifted slightly from the second end 26 so that the disc 44 will pass through the holes 29 and then the shank 42 can be slid within the slot 31 until reaching the curved portion 36. Now, the key loop 21 is permanently mounted within the curved portion 36 but can pivot easily within the slot 31 from the forward position shown in FIG. 1 to the rearward position shown by chain lines 40 in FIG. 2.

The curved portion 36 and the disc 44 are related in size so that the disc 44 sets flat against the walls 37 and 38 in the forward and rearward positions, respectively, of the key loop 21. As a result, these forward and rearward positions of the key loop 21 are stable because of the flat surface seating of the disc 49 against the walls 37 and 38. The offset 45 in the shank 42 provides for holding the horizontal position of the key 22 centered relative to these walls even though the disc 49 is in its full downward position within the curved portion 36.

The coil 43 is preferably oblong in shape and has slightly over one turn (relative to the shank 42). In the coil, the end 47 is spaced laterally a small distance from the axis of the shank 42. The shank 42 merges into the coil 43 slightly offset from the axial extension adjacent the free end 47. With this arrangement, the key 22 having the usual key hole 48 can be slipped between the coil 43 and its free end 47. Then, the key is slightly twisted to mount the end 47 into the key hole 48. Now, the key is slipped onto the first turn of the coil 43 where it is held securely by the resilient wire loop until intentional removal of it is made by the user.

With the key loops 21 installed within the curved portion 36, the plate can be mounted into the body 12 of the key case using the holes 30 and 35 which folding has brought into alignment. Now, the fasteners 19 can be passed through these holes and the body 12 to complete the fabrication of the holder 11.

It will be noted that the second end 27 extends sufficiently beyond the curved portion 37 that the key 22 on the key loop 21, in this rearward position, can be received and rested upon it without injuring the body 12. Various names 49, designs or the like may be placed upon this exposed second part of the plate.

From the foregoing, it will be apparent that there has been provided a novel key holder that is useful, easy to use and provides a permanent mounting of its key loops while yet allowing easy removal of the keys carried in it. It will be appreciated that certain changes and alterations in the key holder can be made without departing from the spirit of this invention. These changes are contemplated by and are within the scope of the appended claims which define the invention. Additionally, the present description is intended to be taken as an illustration of this invention.

What is claimed is:

1. A key holder for releaseably mounting keys on a support member within a key case, the support member comprising:

(a) a thin rectangular metal plate adapted to be folded;

(b) a plurality of uniformly spaced holes aligned laterally across said plate and adjacent to a first end thereof;

(c) a like plurality of thin slots formed into said plate and extending longitudinally from said holes to a certain distance towards a second end of said plate;

(d) a first and second fold line extending transversely across said plate adjacent the ends of said thin slots and adjacent the connection of said slots and said holes, respectively;

(e) said plate folded along said fold lines whereby said first end including said holes rests in juxtaposition along a part of said second end of said plate, and said slots reside in a curved portion of said plate formed therein between said fold lines; and (f) a key loop secured permanently at one end in a slideable mounting within each said slot and at its other end being adapted to be releaseably secured to a key or the like.

2. The key holder of claim 1 wherein said key loop has an integral enlarged end part permanently enclosed within said curved portion of said plate, and said end part is adapted to be inserted through said spaced holes after said plate is folded along said fold lines.

3. The key holder of claim 2 wherein said key loop has a shank portion extending from said end part outwardly of said slots and terminating in an enclosing loop with a laterally spaced free end whereby a key or the like with a mounting aperature can be threaded onto said loop for securely mounting same onto the key holder.

4. The key holder of claim 1 wherein said key loop has an integral enlarged end part, and shank portion extending from said end part and terminating in an enclosing loop, and said key loop is mounted within said slot by passing said end part through said spaced holes after said plate is folded upon said fold lines whereby said end part is permanently secured with said curved portion of said plate and said loop is supported exteriorly thereof on said shank, and a key or the like can be threaded onto said loop for securely mounting same onto the key holder.

5. The key holder of claim 4 wherein said end part is an orificed disc welded to the end of said shank portion on said loop.

6. The key holder of claim 5 wherein said disc has a diameter sufficiently large to provide a flat face against said curved portion on said plate, and said flat face orients said shank in a forward or rearward stable position.

7. The key holder of claim 6 wherein said disc is adapted to rest the shank in its forward and rearward stable position with said shank of said key loop substantially parallel to said plate.

8. The key holder of claim 7 wherein said loop is formed by a resilient metal wire formed into an oval one-turn coil with the free end of said coil terminating adjacent said shank portion but laterally spaced therefrom a small distance for permitting an orificed key to be threaded onto said coil.

9. The key holder of claim 8 wherein said plate has its second end of sufficient length to receive and support full length of a key mounted on said coil when said shank is in its rearward position.

10. The key holder of claim 9 wherein a plurality of aligned mounting holes are provided in said first end and said plate residing in juxtaposition and said aligned mounting holes adapted to receive fasteners for securing said plate into a key case body.

* * * * *